US009658019B2

(12) United States Patent
Smith

(10) Patent No.: US 9,658,019 B2
(45) Date of Patent: May 23, 2017

(54) SILENCER AND MOUNTING SYSTEM

(71) Applicant: RA BRANDS, L.L.C., Madison, NC (US)

(72) Inventor: Michael Leighton Smith, Alpharetta, GA (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 14/858,681

(22) Filed: Sep. 18, 2015

(65) Prior Publication Data

US 2016/0084602 A1 Mar. 24, 2016

Related U.S. Application Data

(60) Provisional application No. 62/052,750, filed on Sep. 19, 2014.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/325; F41A 21/30
USPC ..... 89/14.4; 181/223
See application file for complete search history.

(56) References Cited

U.S. PATENT DOCUMENTS 658,934 A * 10/1900 Washington ..... F41A 21/30 181/223
955,694 A * 4/1910 Riggs ..... F41A 21/30 181/223
958,934 A * 5/1910 Maxim ..... F41A 21/30 181/223
958,935 A * 5/1910 Maxim ..... F41A 21/30 181/223
959,400 A * 5/1910 Stinson ..... F41A 21/30 181/223
981,584 A * 1/1911 Miller ..... F01N 1/06 181/253

(Continued)

FOREIGN PATENT DOCUMENTS

GB 2500568 10/2013
GB 2511387 6/2015

OTHER PUBLICATIONS

AAC Evolution-9. 9MM Shootout and Pistol Trials. Oct. 12, 2007 <http://www.silencerresearch.com/9mm—shootout—and—pistol—trials.htm> and <http://web.archive.org/web/*/http://www.silencerresearch.com/9mm—shootout—and—pistol—trials.htm> and <http://web.archive.org/web/20071012150848/http://silencerresearch.com/9mm—shootout—and—pistol—trials.htm>.

(Continued)

*Primary Examiner* — Joshua Freeman
(74) *Attorney, Agent, or Firm* — Womble Carlyle Sandridge & Rice, LLP

(57) ABSTRACT

The disclosure generally relates to a booster for a silencer. The booster includes a piston with a proximal end and a distal end. The proximal end of the piston is configured to couple to a firearm such that a projectile can pass thorough the piston from the proximal end to the distal end. The distal end of the piston includes a flange with a plurality of spokes. The booster further includes a housing with an eccentric bore configured to couple to a silencer. The eccentric bore aligns the silencer below the sight plane of the firearm.

15 Claims, 8 Drawing Sheets

(56) References Cited

U.S. PATENT DOCUMENTS 984,750 A * 2/1911 Craven ..... F41A 21/30 181/223
1,000,702 A * 8/1911 Thurler ..... F41A 21/30 181/223
1,021,742 A * 3/1912 Moore ..... F41A 21/30 181/223
1,054,434 A * 2/1913 Bailey ..... F41A 21/30 89/14.4
1,207,264 A * 12/1916 Bailey ..... F41A 21/30 181/223
1,462,158 A 7/1923 Wildner
1,525,846 A 2/1925 Lorenz
1,773,443 A 8/1930 Zygmunt
2,448,382 A 8/1948 Mason
2,448,593 A * 9/1948 Heising ..... F41A 21/30 89/14.2
3,164,060 A 12/1964 Dahl
3,500,955 A 3/1970 Werbell
3,677,132 A 7/1972 Plenge
5,029,512 A 7/1991 Latka
5,136,924 A 8/1992 Forster et al.
5,164,535 A 11/1992 Leasure
5,559,302 A 9/1996 Latka
5,685,102 A 11/1997 Latka
5,773,746 A 6/1998 Vaden
6,575,074 B1 6/2003 Gaddini
6,948,415 B2 9/2005 Matthews et al.
7,059,235 B2 6/2006 Hanslick et al.
7,308,967 B1 12/2007 Hoel
7,353,740 B1 4/2008 Hoffman
7,516,690 B2 4/2009 McClellan
7,558,122 B2 7/2009 Kim et al.
7,588,122 B2 9/2009 Brittingham
7,594,464 B2 9/2009 Dueck
7,610,710 B2 11/2009 Brittingham
7,676,976 B2 3/2010 Dueck et al.
7,677,150 B2 3/2010 Dater et al.
7,743,693 B1 6/2010 Brittingham
7,789,009 B1 9/2010 Brittingham
7,891,282 B1 2/2011 DeGroat
7,905,171 B1 3/2011 Brittingham
7,946,069 B2 5/2011 Dueck et al.
8,015,908 B2 9/2011 Kline et al.
8,091,462 B2 1/2012 Dueck et al.
8,162,100 B2 4/2012 Shults et al.
8,272,306 B1 9/2012 Smith
D677,357 S 3/2013 Dueck et al.
8,387,299 B1 3/2013 Brittingham et al.
8,424,441 B2 * 4/2013 Brittingham ..... F41A 21/26 181/223
8,439,155 B2 5/2013 Shults et al.
8,453,789 B1 6/2013 Honigmann et al.
8,459,406 B1 6/2013 Dueck
8,479,632 B2 7/2013 Kline et al.
8,528,691 B1 9/2013 Carmichael et al.
8,584,794 B2 11/2013 Dueck
8,714,300 B2 5/2014 Johansen
8,714,301 B2 5/2014 Shults
8,857,306 B1 10/2014 Edsall
8,950,546 B2 2/2015 Shults et al.
8,991,550 B2 * 3/2015 Coley ..... F41A 21/30 181/223
8,997,621 B1 4/2015 Dater et al.
9,097,482 B1 * 8/2015 Holden ..... F41A 21/30
9,103,618 B2 8/2015 Daniel et al.
9,121,656 B1 9/2015 McKenzie
9,175,919 B2 11/2015 Russell et al.
9,261,317 B2 2/2016 Daniel et al.
9,291,418 B2 3/2016 McNitt
9,316,456 B1 * 4/2016 Oliver ..... F41A 21/30
9,328,984 B2 5/2016 Shults et al.
2007/0095198 A1 5/2007 Dater et al.
2008/0098880 A1 5/2008 Brugger
2008/0148928 A1 * 6/2008 McClellan ..... F41A 21/34 89/14.4
2009/0050403 A1 * 2/2009 Brittingham ..... F41A 21/325 181/223
2010/0229712 A1 9/2010 Graham
2011/0061966 A1 * 3/2011 Brittingham ..... F41A 21/30 181/223
2011/0067950 A1 * 3/2011 Shults ..... F41A 21/30 181/223
2011/0088540 A1 4/2011 Brittingham et al.
2012/0279381 A1 11/2012 Landolt
2013/0133976 A1 5/2013 Johansen
2014/0020976 A1 1/2014 Shults
2014/0158459 A1 6/2014 Shults et al.
2015/0226506 A1 8/2015 Shults
2015/0292829 A1 10/2015 Pietila
2016/0084602 A1 * 3/2016 Smith ..... F41A 21/30 89/14.4
2016/0209149 A1 * 7/2016 Fischer ..... F41C 33/02

OTHER PUBLICATIONS

AAC Glock 9mm Suppresors, for Glock 17, 19, and 26 with AAC Evolution-9, Spider-2, Scorpion!; by Al Paulson; Combat Handguns; Harris Publications; Jun. 2006 issue.

AAC's Evolution-9, Suppressing hard-to-silence 9mm pistols including Beretta 92F; by Al Paulson; Special Weapons for Military and Police; Harris Publications; Fall 2002 issue.

Multimount System. (2008) Retrieved from http://www.gem-tech.com/MultiMount.html.

* cited by examiner

SILENCER AND MOUNTING SYSTEM

CROSS REFERENCE TO RELATED APPLICATION

The present Patent Application is a formalization of previously filed, U.S. Provisional Patent Application Ser. No. 62/052,750, filed Sep. 19, 2014 by the inventor named in the present Application. This Patent Application claims the benefit of the filing date of this cited Provisional Patent Application according to the statutes and rules governing provisional patent applications, particularly 35 U.S.C. §119 (e), and 37 C.F.R. §§1.78(a)(3) and 1.78(a)(4). The specification and drawings of the Provisional Patent Application referenced above are specifically incorporated herein by reference as if set forth in their entirety.

FIELD OF THE DISCLOSURE

The present disclosure relates to silencers, and in particular to a rotationally adjustable mounting system for silencers with a bore axis that is eccentrically located with respect to an outer body of the silencer.

BACKGROUND

Silencers for firearms, including rifles and handguns, are well known and have been used for reducing muzzle flash and the sound signature of a host firearm, and thus offer many advantages to the user. For example, muzzle flashes can be harmful to the user's night vision and can also provide a visual cue about the location of the person discharging a firearm. Likewise, the sound or report upon firing a firearm will also provide an audible cue about the location of a shooter and can further cause significant harm to the shooter's hearing. Silencers have been developed to mitigate or substantially reduce these concerns. However, when a conventional silencer with a concentric bore is incorporated with a pistol, the silencer often will obstruct or substantially block the sight plane of the firearm, thus eliminating the use or benefit of the sight. Therefore, while the addition of such a conventional silencer to a firearm can provide benefits in terms of reducing sound and/or muzzle flash, it also may reduce or otherwise affect a user's accuracy.

Consequently, there exists a need for a silencer and mounting system that enables a user to quickly, easily, and securely mount and orient the silencer on the host firearm with a bulk of the silencer body lying beneath the bore axis of the silencer, so that the sight plane of the host firearm is undisturbed. There also exists a need for a silencer and a mounting system therefor that is easily accessible by a user, and allows the user to remove and reinstall a baffle core of the silencer in such a way that an eccentric bore defined through the baffle core will be concentric with an eccentric bore defined through the mounting apparatus that couples the silencer to the barrel of a firearm, and which further may address other related and unrelated problems in the art.

BRIEF SUMMARY

The present disclosure generally relates to a silencer and mounting system therefor, comprising a silencer mount, which can comprise or be configured as a booster configured to assist in a proper function of a firearm on which it is mounted. Each of the silencer and the booster can have an offset or eccentric bore defined along the body thereof, wherein these eccentric bores can be coaxial. Further, a system for adjustably orienting the silencer in relationship to a sight plane extending along the muzzle of a host firearm is also provided. In this regard and in one embodiment, the booster can comprise a piston having a body with proximal and distal ends and a longitudinal bore extending therethrough, defining a central passage a projectile will pass through upon firing the host firearm. The proximal end of the piston is configured to couple to a firearm muzzle, such as by a threaded engagement or other releasable connector, while the distal end of the piston generally can comprise a flange that can include a plurality of spokes. The booster further comprises a housing adapted to couple to the silencer for mounting the silencer on the host firearm, with the offset or eccentric bore of the booster defined therethrough, along which the piston body and central passage thereof are received and aligned. The silencer generally will include a body or housing having a bore, with a baffle core received along the bore of the silencer body, the baffle core having a bullet passage defined therethrough that can be located at an offset position or in an eccentric arrangement relative to the silencer body. The baffle core further can comprise one or more baffles formed separately or integrally with one another.

In use, the piston is received along the eccentric bore of the booster, with the central passage defined through the piston being coaxially aligned with the eccentric bore of the booster. The distal end of the piston generally can be biased or directed into engagement with a shoulder or stepped portion of the booster housing, with the spokes of the piston engaging corresponding recesses, slots or notches defined along the stepped portion of the booster housing to rotationally secure the booster housing relative to the piston. The silencer thereafter is received over and secured to the booster housing, such as by a threaded or other suitable connection, and then the proximal end of the piston can be coupled to a firearm muzzle to mount the silencer to the firearm. The orientation of the silencer body can be adjusted as needed to shift or rotate the body of the silencer out of the sight plane of the firearm by movement of the booster housing, with the silencer mounted thereto, longitudinally with respect to the piston, sufficient to disengage the spokes of the piston from the recesses or notches of the booster housing. While the spokes and notches are disengaged, the silencer body can be rotated to a desired alignment, after which the booster housing can be biased back into engagement with the piston (e.g., the spokes and recesses reengaged) sufficient to secure the silencer in the desired alignment/orientation with respect to the sight plane of the firearm.

As another example, the spokes of the piston and the notches of the booster housing can be disengaged from one another in response to translational relative movement therebetween in a first direction, and reengaged to one another in response to translational relative movement therebetween in a second direction that is opposite the first direction, wherein at least one spring can drive the movement in the second direction. While the spokes and notches are engaged, relative rotation between the piston and the booster housing, and, thus, the body of the silencer is restricted. In contrast, while the spokes and notches are disengaged, the booster housing and silencer body can rotate together relative to the piston. The baffle core can be operatively connected to the booster housing and/or silencer body so that the baffle core rotates with the booster housing and silencer body, so that the eccentric bores of the baffle core and booster housing remain coaxial with one another during rotational adjustment of the silencer. For example, the baffle core can be operatively connected to the booster housing by way of cooperative mated elements that can be configured to restrict relative rotation between the baffle core and booster housing. The mated elements can generally comprise a tongue received in a corresponding groove or hole, or any other suitable structures, and they further can be operative during assembly of the silencer for ensuring that the baffle core is properly installed in the silencer body so that the eccentric bores of the baffle core and booster housing generally are arranged or aligned coaxial with one another.

Various features, advantages, and embodiments of the disclosure may be set forth or apparent from consideration of the following Detailed Description, the appended drawings, and the claims. Moreover, it is to be understood that both the foregoing summary and the following detailed description are exemplary and intended to provide further explanation without limiting the scope of this disclosure.

BRIEF DESCRIPTION OF THE DRAWINGS

The accompanying drawings, which are included to provide a further understanding of features of this disclosure, are incorporated in and constitute a part of this specification, illustrate embodiments of this disclosure, and together with the detailed description, serve to explain the principles of this disclosure. No attempt is made to show structural details of the embodiments in more detail than may be necessary for a fundamental understanding of the embodiments and the various ways in which the embodiments may be practiced. In addition, it will be understood by those skilled in the art that the invention and the various features thereof discussed below are explained in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques further may be omitted so as to not unnecessarily obscure the embodiments of this disclosure.

DETAILED DESCRIPTION OF THE INVENTION

Examples of embodiments are described below and illustrated in the accompanying drawings, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. For example, features illustrated or described as part of one embodiment can be used in the context of another embodiment to yield a further embodiment, and these further embodiments are within the scope of the present invention.

Figure 4:
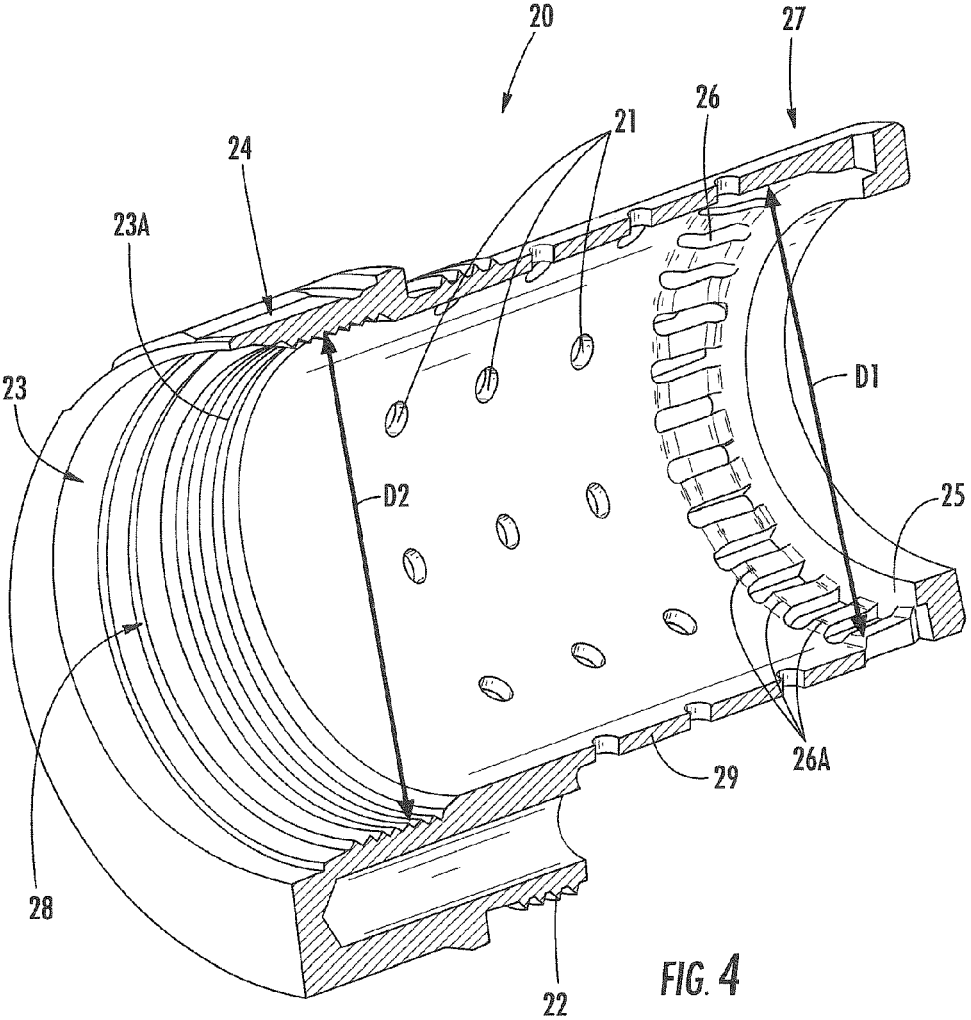
FIG. 4 is an isolated, sectional view of a housing of the mounting system of FIG. 2.
Figure 5:
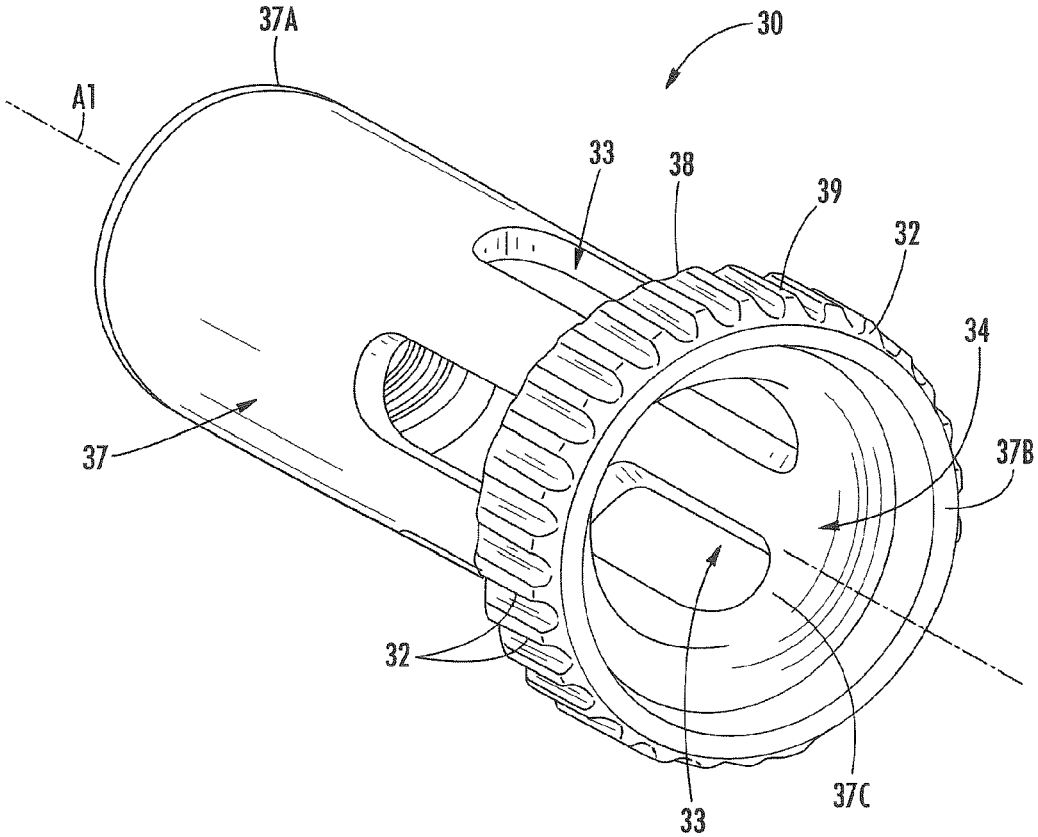
FIG. 5 is an isolated, perspective view of a piston of the mounting system of FIG. 2.
Figure 6:
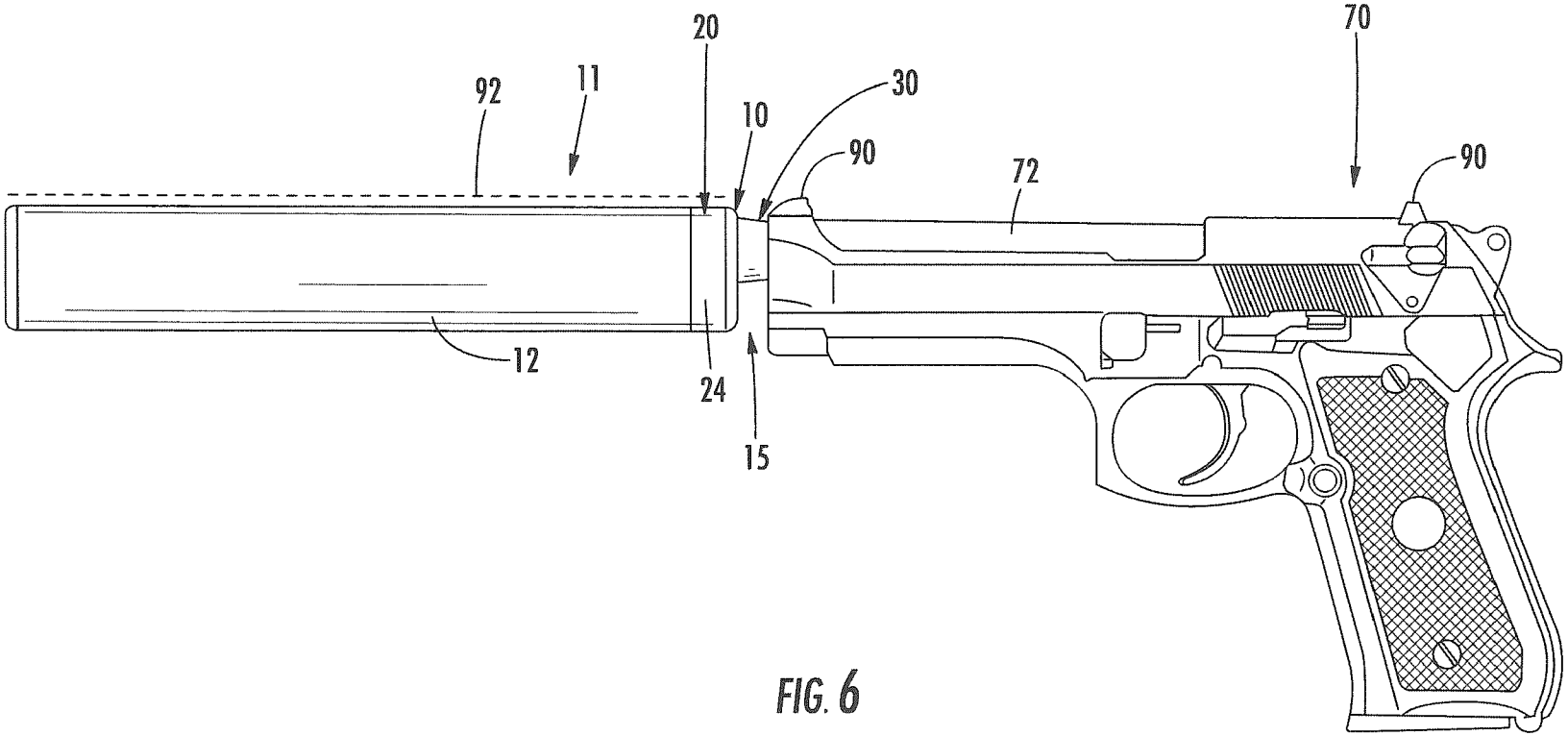
FIG. 6 is a side view of an example of a combination of a firearm and silencer utilizing the mounting system of FIGS. 1A-5, in accordance with an embodiment of this disclosure.

Turning now to the drawings, FIGS. 1A-6 illustrate features of an embodiment of a mounting system 10 for adjustably mounting a silencer 11 or noise suppressor to a firearm 70 (FIG. 6). As one example, in FIG. 6 the firearm 70 is shown in the form of a handgun. Those of ordinary skill in the art will understand that the mounting system 10 can be used with various other types of firearms 70, including, but not limited to, rifles and other types of long guns, as well as various other types of pistols or handguns.

The mounting system 10 (FIGS. 1A-3) generally can include a silencer or suppressor mount 15 that can be configured as a recoil booster or a "Nielson device," and is adapted to enable adjustable orientation of an attached silencer 11 once mounted to the firearm 70. In one embodiment of this disclosure, the silencer mount or recoil booster 15 can comprise a housing 20, piston 30, rear cap 40, and at least one compression spring 50.

Figure 1A:
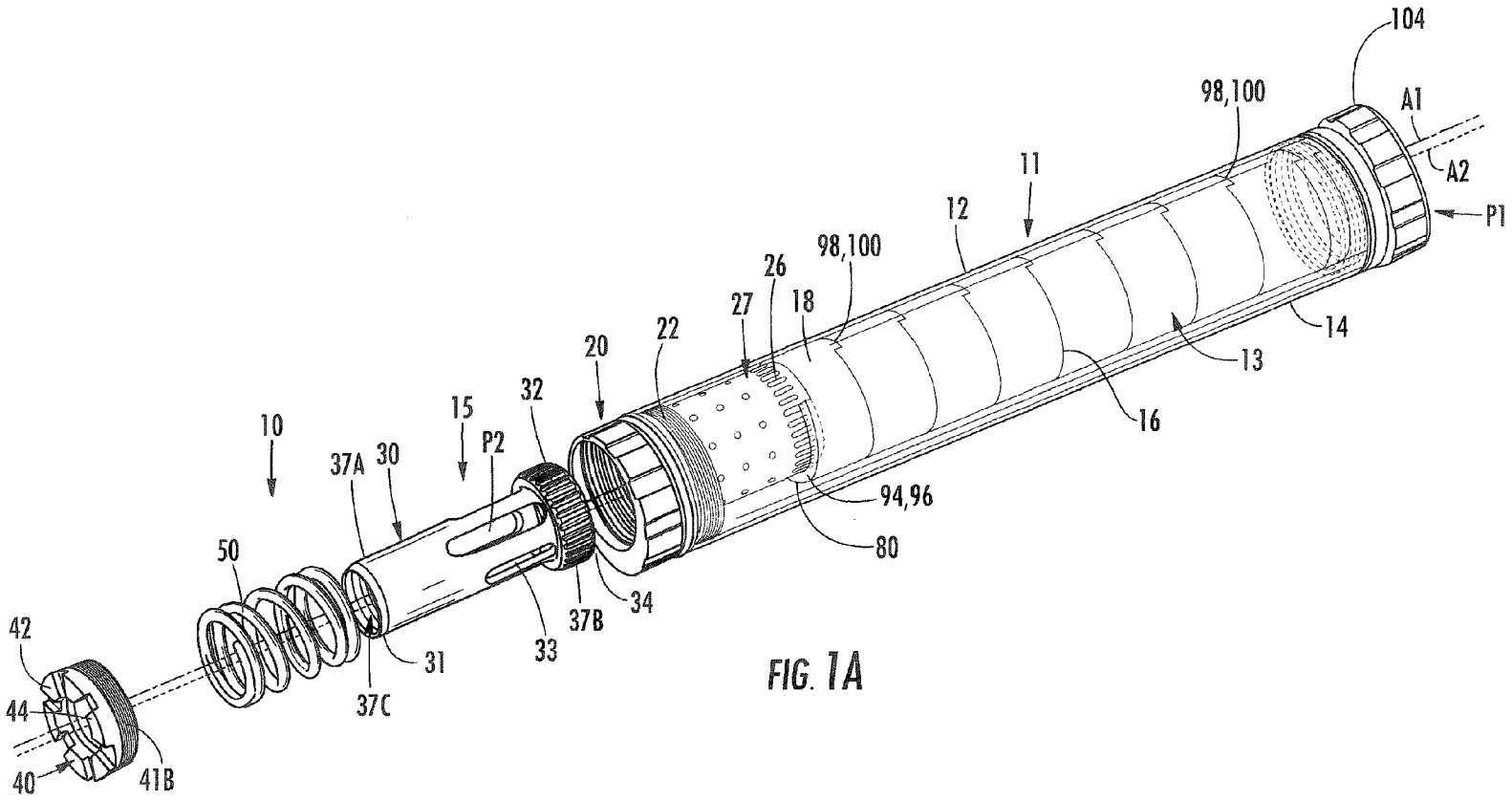
FIG. 1A is a partially exploded perspective view illustrating features of a silencer and a mounting system for the silencer configured to enable adjustable orientation of the silencer after mounting to a firearm according to the principles of the present invention.
Figure 1B:
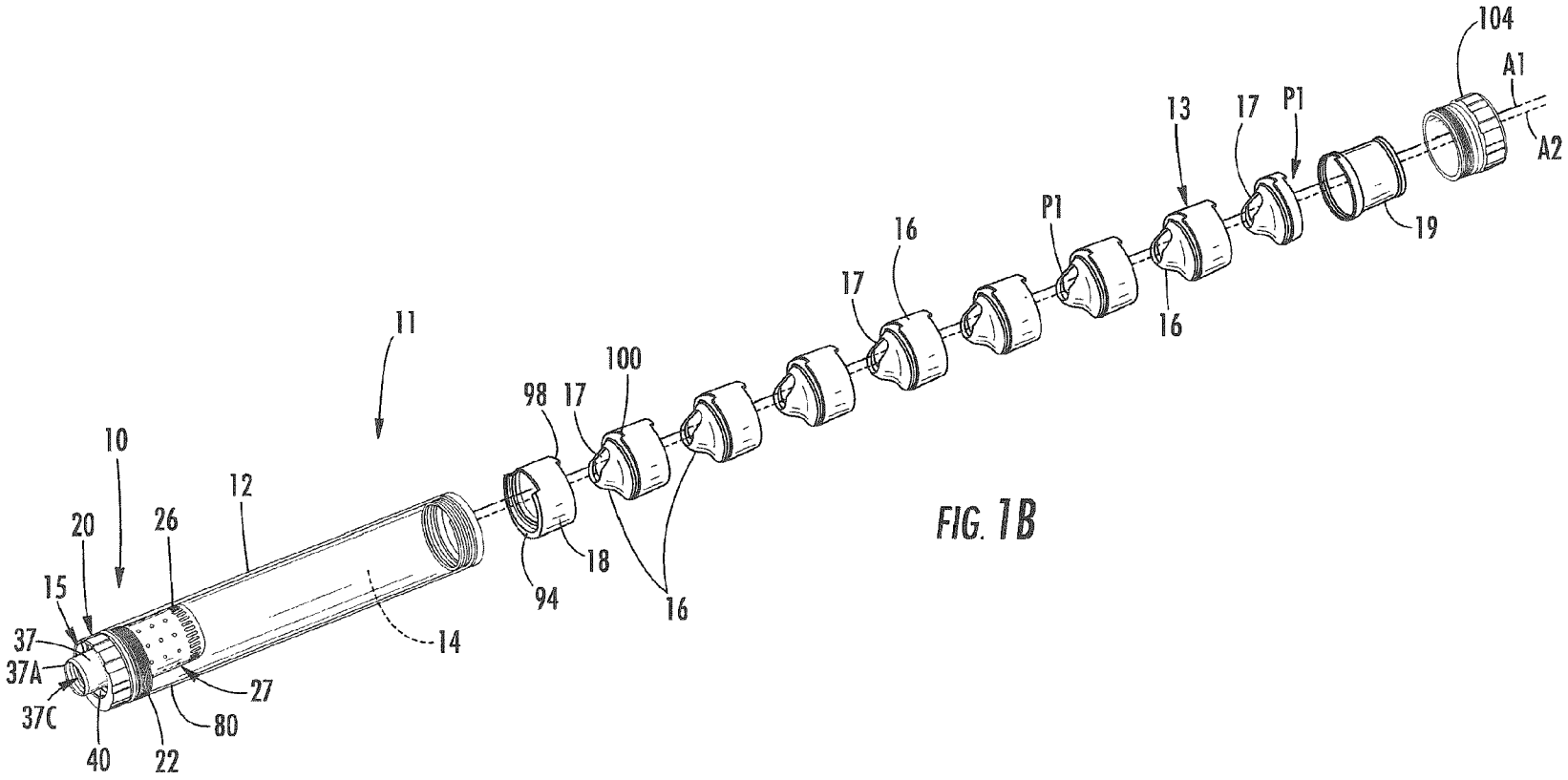
FIG. 1B is a partially exploded perspective view of the silencer and mounting system of FIG. 1A with a baffle core including a series of baffles, in accordance with an embodiment of this disclosure.
Figure 1C:
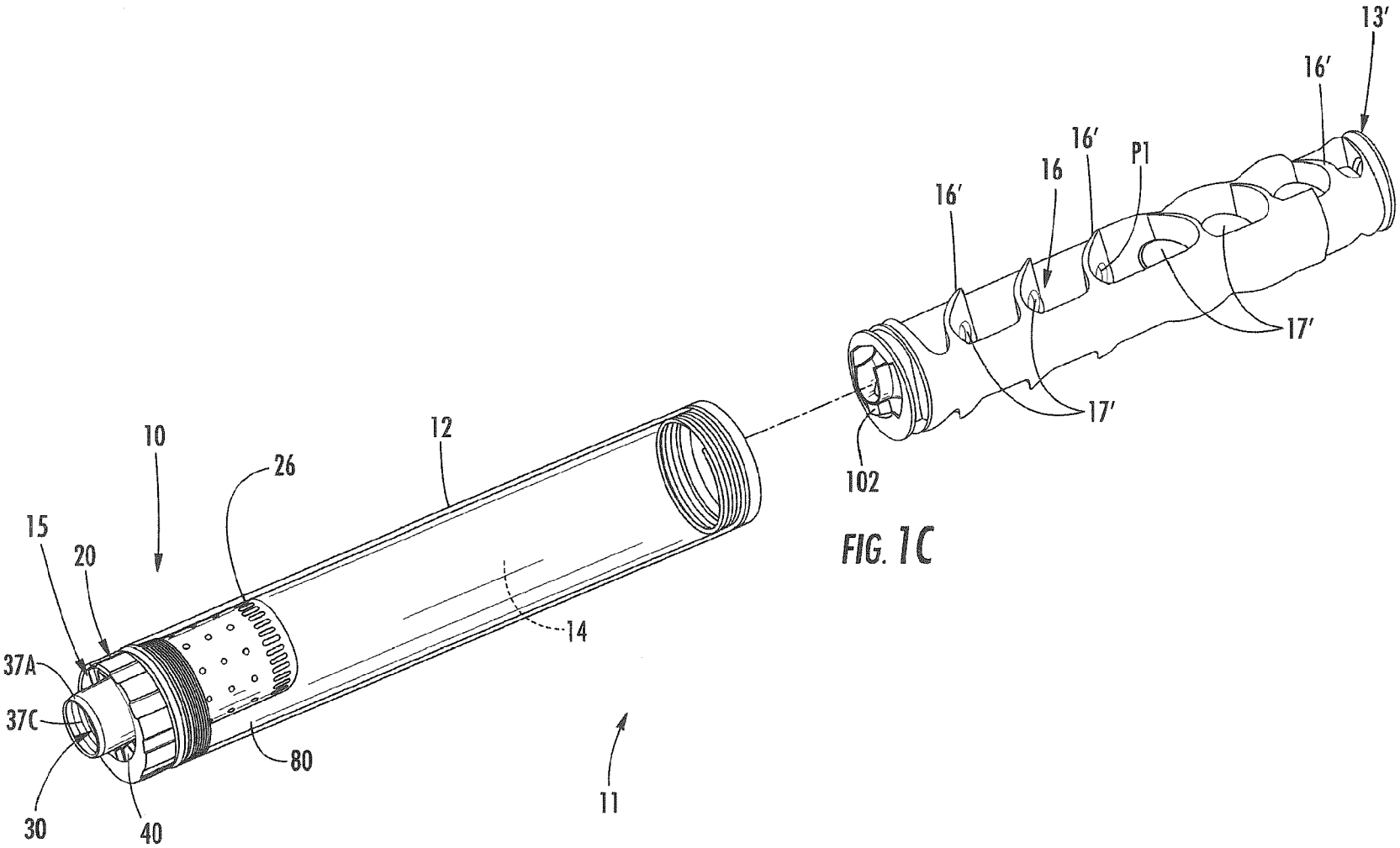
FIG. 1C is a partially exploded perspective view illustrating features of a silencer and a mounting system for the silencer, wherein the mounting system is configured to allow for adjustable orientation of the silencer after mounting to a firearm, and with the silencer including a substantially unitized baffle core, in accordance with an embodiment of this disclosure.
Figure 2:
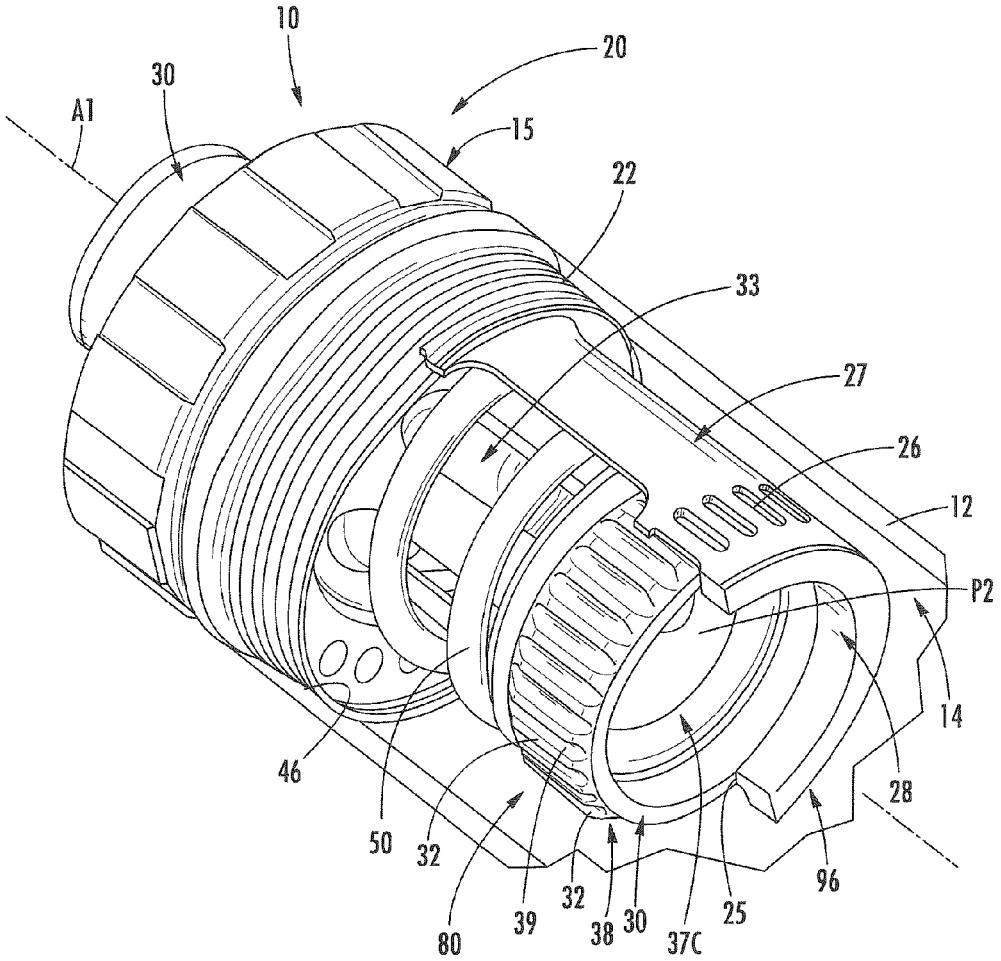
FIG. 2 is a perspective, partially cut-away view illustrating a mounting system mounted in an end of a body of a silencer, in accordance with an embodiment of this disclosure.
Figure 3:
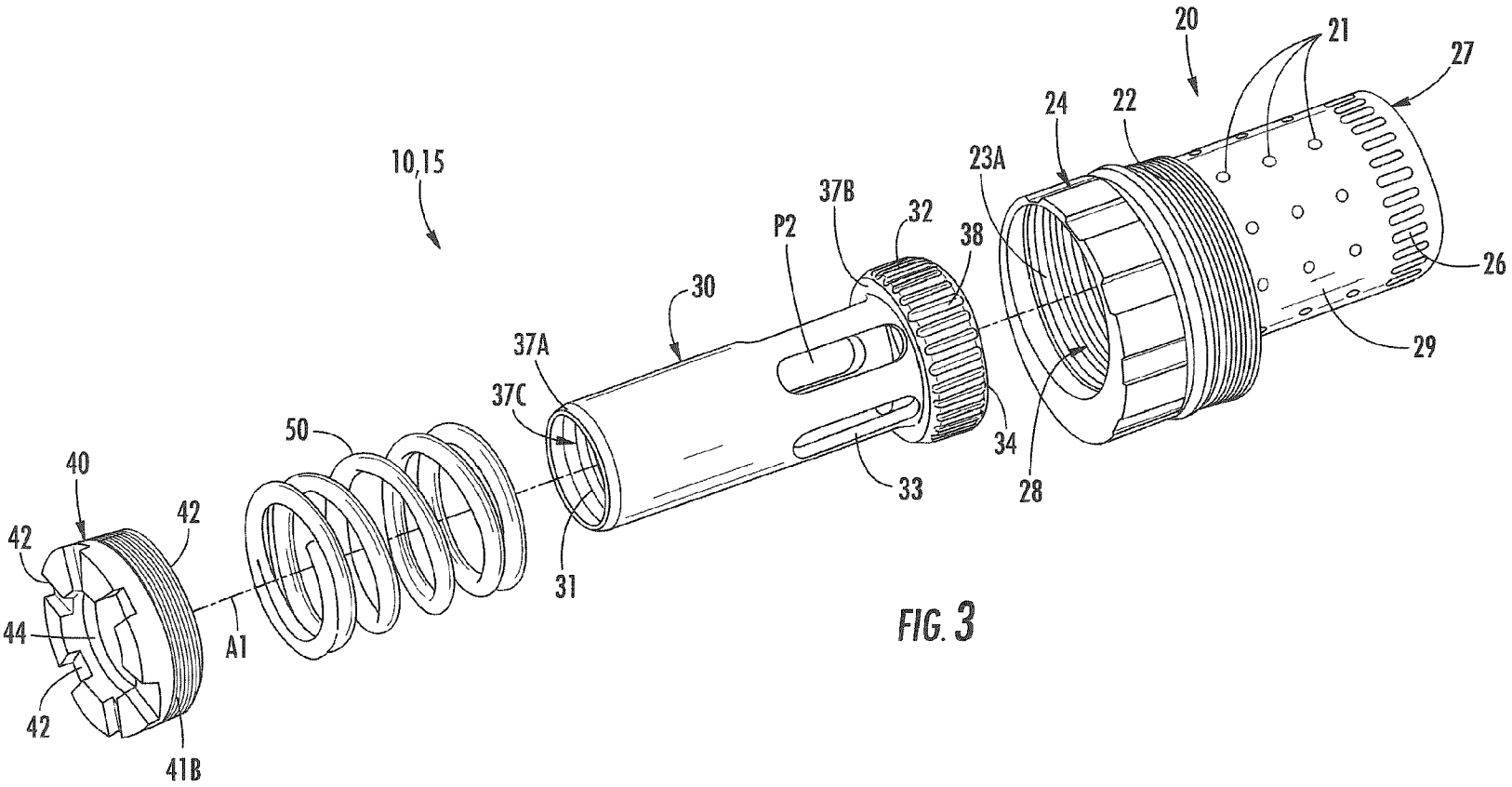
FIG. 3 is an isolated, exploded perspective view of the mounting system of FIG. 2.

As used herein and for example, the terms "front" or "distal" generally will correspond to the direction or position at which a discharged projectile would exit the silencer mount 15 (i.e., to the right as shown in FIGS. 1A-3); "rear" or "proximal" or "back" will correspond to the direction or position at which a discharged projectile would enter the silencer mount 15 (i.e., to the left as shown in FIGS. 2 and 3); "longitudinal" generally refers to a direction extending along or parallel to a longitudinal axis A1 (FIGS. 1A and 1B) extending through a piston bore 37C or projectile passage P2, of the piston 30 and an eccentric bore of the booster housing (FIGS. 3 and 4) of the silencer mount 15 and a passage P1 of the silencer, or a longitudinal axis A2 (FIGS. 1A and 1B) of an outer body or housing 12 of the silencer 11; while "transverse" generally refers to a direction crosswise to, or more specifically perpendicular to, the longitudinal direction.

As indicated in FIGS. 1A and 6, the silencer 11 generally can comprise an eccentrically configured silencer or suppressor, including the elongated body 12, which can be cylindrical, rectangular, or otherwise configured. In FIGS. 1A-2, the cylindrical silencer body 12 is schematically shown as being transparent, for at least partially showing internal features. In the embodiment shown in the drawings, the silencer body 12 can define a generally cylindrical interior chamber 14 that is coaxial with the silencer body, though other configurations also can be used.

A baffle core 13 typically can be received within an interior chamber 14 of the silencer body 12. As illustrated in FIGS. 1A and 1B, in one embodiment, the baffle core 13 can include a series of asymmetric or eccentric baffles 16 each having an opening or bore 17 (FIG. 1B) with the aligned bores 17 of the baffles defining a passage P1 (FIG. 1B) aligned with the passage P2 of the piston bore 37C of the silencer mount, and through which a projectile will pass through the silencer 11. The baffles 16 can be eccentric by virtue of the bores 17 extending eccentrically through the baffles. In the embodiment shown in the drawings, the baffles 16 can have cylindrical outer walls and the bores 17 can be configured so that they are eccentrically positioned relative to the outer walls of the baffles and coaxial with the longitudinal axis A1 of the piston bore 37C. Accordingly, the projectile passage P1 can be eccentric relative to the silencer body 12, and the silencer 11 can be referred to as an eccentric silencer. The baffle core 13 can further include one or more spacers, such as proximal and distal spacers 18, 19 at the ends of the series of baffles 16, and the spacers 18, 19 can have bores therethrough that are part of the passage P1 through which a projectile will pass through the silencer 11.

In the embodiment shown in FIGS. 1A and 1B, at least portions of the projectile passages P1-P2 of the baffle core of the silencer 11 and the piston bore of the piston of the silencer mount 15 (FIG. 1B) further can simultaneously be coaxial with the longitudinal axis A1 of the eccentric bore 28 of the silencer mount 15, and offset from or eccentric relative to the longitudinal axis A2 of the silencer body 12. Even with a majority of the projectile passage P1 being offset from the longitudinal axis A2 of the silencer body 12, the silencer 11 can have the appearance of a substantially cylindrical silencer. For example, the outer surface of the silencer body 12 can be cylindrical. The projectile passage P1 also can be offset from the longitudinal axis A2 of the silencer body 12 so that a larger portion of the silencer body will be below and/or offset from the projectile passage P1.

In another embodiment as illustrated in FIG. 1C, a baffle core 13' can be configured generally as discussed above, except that the baffle core can be machined or cast as a substantially one-piece or single, unitized module. The baffle core 13' can include a series of asymmetric or eccentric baffles 16' each having an opening or bore 17' with the aligned bores 17' of the baffles defining the passage P1 through which a projectile will pass through the silencer 11. The bores 17' can be configured so that they are eccentrically positioned relative to the baffles 16' and coaxial with the longitudinal axis A1 (FIGS. 1A and 1B) of the eccentric bore 28 (FIG. 4). Additionally, the baffle cores 13, 13' can be removed for replacement and/or for cleaning out debris left by the fired projectile and the burning gases.

FIGS. 1A and 3 show exploded views of the components which can comprise one embodiment of the mounting system 10 for adjustably mounting the silencer 11 to the firearm 70. As illustrated in FIG. 4, the housing 20 of the silencer mount or booster 15 can include a substantially or generally cylindrical body 29 having a stepped or offset configuration, including a first, rear or proximal base portion 24 and a forward, downstream or distal portion 27 extending forwardly of the base portion 24. In the embodiment shown in the drawings, the stepped or offset configuration of the body 29 is configured so that the distal portion 27 is laterally, eccentrically arranged relative to the base portion 24. For example, each of the base portion 24 and the distal portion 27 can be substantially cylindrical, with the cylindrical axes of the base portion 24 and the distal portion 27 being both laterally offset and parallel to one another. In this regard, the booster housing 20 can define the eccentric bore 28 (FIGS. 3 and 4) of the silencer mount 15 in a manner such that the eccentric bore 28 is eccentric with respect to base portion 24, yet coaxial with respect to the distal portion 27. More specifically, the base portion 24 can have a substantially or generally cylindrical outer wall, wherein the eccentric bore 28 can be eccentrically positioned relative to the outer wall of the base portion 24. In contrast, the distal portion 27 can have a substantially or generally cylindrical outer wall, wherein the eccentric bore 28 can be coaxially positioned relative to the outer wall of the distal portion 27.

Referring to FIG. 4, in one embodiment the distal portion 27 of the booster housing 20 can have a series of vent holes 21 that extend through the wall that defines the cylindrical body 29 of the booster housing, wherein the vents 21 can be located all around the central portion of the booster housing 20. The vent holes 21 can be configured so that that at least some of the expanding gases produced from a discharged firearm 70 (FIG. 6) coupled to the booster 15 can escape from within the eccentric bore 28 of the booster housing 20 by passing through the vents 21 in a direction substantially transverse to the path P1 (FIG. 1B) of a discharged projectile.

With continued reference to FIG. 4, the base portion 24 of the booster housing 20 can define an enlarged opening or proximal portion 23 of the eccentric bore 28 so that the proximal portion 23 is configured to receive the rear cap 40, so that a shaft of the piston 30 can extend through a central hole or opening 44 (FIGS. 1A and 3) in the rear cap. In one embodiment, the distal portion of the bore 28 can have a first diameter D1 that can be smaller than a second diameter D2 of the proximal portion 23 of the eccentric bore 28. Generally similarly, the outer diameter of the base portion 24 of the booster housing 20 can be larger than the outer diameter of the distal portion 27 of the booster housing. As shown in FIG. 4, the distal portion of the bore 28, which has the first diameter D1, can be concentric with the proximal portion 23 of the eccentric bore 28, which has the second diameter D2. Alternatively, there can be a lateral offset between the distal portion of the eccentric bore 28, which has the first diameter D1, and the proximal portion 23 of the eccentric bore 28, which has the second diameter D2. The base portion 24 further can have at least one external helical thread 22, at least one internal helical thread 23A and/or other suitable connector features for respectively coupling to the silencer body 12 and rear cap 40, as will be discussed in greater detail below.

Referring to FIGS. 2 and 4, the eccentric bore 28 can be referred to as a piston bore, as the piston 30 will be received and can reciprocate therein. The distal portion 27 of the booster housing 20 can include a stop surface 25, which can be in the form of an annular inner shoulder, against which forward movement of the piston 30 can be arrested. Also, at the distal end of the booster housing 20 can be a series of internal indexing slots or notches 26. As shown in FIG. 2, the notches 26 can extend through a cylindrical outer surfaced of a wall portion of the distal portion 27, but alternatively the notches 26 may not extend so far radially outwardly. As shown in FIG. 4, each longitudinally extending notch 26 can be at least partially defined between a pair of longitudinally extending, inwardly protruding ribs 26A of the distal portion 27 of the booster housing 20.

In one embodiment, as shown in FIGS. 1A and 5, the piston 30 will have a body 37 with a proximal end 37A and a distal end 37B between which a bore 37C defining a projectile passage P2 through which the projectile will pass upon firing, extends. As shown in FIGS. 1A-1C, the distal end 37A of the piston body generally will be received within and project along the bore 28 of the booster housing 20, over which the silencer will be mounted, with the distal end of the booster housing further being received within the body of the silencer and with the projectile passage P2 of the piston 30 located in alignment with the projectile passage P1 of the silencer.

The distal end of the piston 30 further can have a head or flange 38 including a series of longitudinally extending, radiused cuts 39 that form points or longitudinally extending spokes 32 which protrude outwardly from a portion of the head or flange 38 of the piston 30. The spokes 32 can be spaced evenly about the distal end of the piston 30, and the spokes 32 can be configured (e.g., machined) so that they are translatable with the piston within the booster housing 20. The indexing notches 26 spaced about the interior of the booster housing 20 can be configured (e.g., machined) so that they can respectively receive and/or engage the spokes 32 spaced about the distal end of the piston 30 when the piston 30 is placed into the booster housing 20. The spokes/cuts of the piston flange and corresponding notches 26 of the booster housing define cooperative locking elements between the piston and housing, whereby the engagement between the spokes 32 on the piston 30 and the notches 26 in the booster housing 20 can have the effect of rotationally locking together the piston and the booster housing so as to substantially prevent the booster housing 20 from rotating relative to the piston when the piston is fully seated in the booster housing. Thus, the spokes 32 on the piston 30 and the notches 26 in the booster housing 20 can be cooperatively configured for restricting relative rotation between the piston and the booster housing when the piston is fully seated in the housing.

In one embodiment, as illustrated in FIGS. 4 and 5, the booster housing 20 and the piston 30 can include any suitable number of notches 26 and/or spokes 32 to increase or decrease adjustability of the silencer 11. For example, an increase in the number of notches 26 can increase a number of adjustable positions of the silencer 11, as will be discussed in greater detail below. In contrast, a decrease in the number of notches 26 can decrease an amount of adjustable positions of the silencer 11. While the booster housing 20 and piston 30 are shown in the drawings as having thirty notches 26 and thirty spokes 32, more or less notches and/or spokes can be included without departing from the spirit of the invention. In one example, there can be at least ten notches 26 and at least ten spokes 32.

In one illustrative embodiment, proximate the spokes 32 can be a series of holes or vents 33 (FIGS. 2, 3 and 5) that extend through a cylindrical sidewall of the piston 30 and provide an escape path for the expanding gases of a firearm 70 (FIG. 6) connected to the proximal end of the piston, so that the gasses can flow laterally out of an interior projectile passageway P2 that extends through the piston and exit into the eccentric bore 28 of the booster housing 20, and thereafter into the interior chamber 14 defined by the silencer body 12. The vents 33 can be spaced evenly about the exterior of the piston 30 body adjacent the piston head 38. The proximal end of the piston 30 can have at least one internal helical thread 31 (FIG. 3) and/or other suitable connector features configured to attach the piston 30 to a corresponding external helical thread and/or other suitable connector features at the muzzle end of a firearm barrel 72. As illustrated in FIGS. 1A, 2 and 3, the compression spring 50 can have a central void large enough to accommodate the shaft of the piston 30, and small enough so that the distal end of the spring drivingly engages a proximal shoulder defined by the head or flange 38 of the piston.

Referring to FIG. 3, the proximal end of the rear cap 40 can have at least one or a series of recesses or grooves 42. In one embodiment, the rear cap 40 can have four recesses or grooves 42 that are approximately equal spaced apart from one another by 90 degrees across a central opening 44 of the rear cap 40, wherein the central opening can be located in the center of the rear cap 40. The recesses 42 can be configured for functioning as a drive feature by which the rear cap 40 can be rotated in order to be secured by way of mated helical threads. For example, the proximal end of the booster housing 20 can have at least one internal helical thread 23A configured to receive a helical thread 41B on the distal end of the rear cap 40, or the like. In addition or alternatively, other suitable connector features can be used to couple the rear cap 40 and booster housing 20 to one another. In the embodiment illustrated in the drawings, the central opening 44 of the rear cap 40 is configured (e.g., machined) so that the proximal end of the shaft of the piston 30 can extend therethrough and reciprocate therein.

FIG. 2 shows the silencer mount 10 in a fully assembled configuration, and FIG. 2 further shows the silencer mount 10 connected to the proximal end portion of the silencer body 12 with the projectile passage P2 of the piston 30 in alignment with the projectile passage P2 defined through the silencer body 12, in accordance with an embodiment of this disclosure. In FIG. 2, the silencer body 12 is schematically shown as being transparent. The connection between the silencer mount 10 and the proximal end portion of the silencer body 12 can comprise a helical threaded connection or engagement between the external helical threads 22 of the base portion 24 of the booster housing 20 and corresponding internal helical threads 46 of the silencer body 12, such that the distal portion 27 of the booster housing is positioned in a proximal portion of the bore 14 of the silencer body 12. In addition or alternatively, other suitable connecting features further can be used to couple the base portion 24 and the silencer body 12 to one another.

In the fully assembled configuration of the silencer mount 10, components can be configured so that a majority of the piston 30 is located within the booster housing 20, the compression spring 50 surrounds the shaft of the piston 30, and the rear cap 40 encloses the compression spring 50 and a portion of the piston 30 received within the booster housing 20. With the silencer mount 10 is in its assembled configuration, at least the distal portion of the piston 30 and the spring 50 can be substantially permanently installed/contained in the silencer mount, such as by substantially fixedly connecting the rear cap 40 to and/or within the enlarged proximal portion 23 (FIG. 4) of the eccentric bore 28 that is defined by the base portion 24 of the booster housing 20, such as with one or more suitable fastening mechanisms. For example, the substantially fixed connection between the rear cap 40 and the proximal end portion of the booster housing 20 can be at least partially provided by adhesive material, such as Loc-tite® or other material, securing together the helical threads 23B, 41B of the rear cap and booster housing.

FIG. 6 shows an external side view of the silencer 11 secured to the end of the barrel 72 of a handgun 70 by way of the above-discussed silencer mount or eccentric booster 15, wherein the eccentric booster 15 is configured to allow for adjustable eccentric orientation of the silencer relative to the barrel, in accordance with an embodiment of this disclosure. The booster 15 can be fixedly connected to both the muzzle of the barrel 72 and the silencer body 12 as discussed above. Referring to FIG. 2, the outer diameter of the distal portion 27 of the booster housing 20 can be smaller than the inner diameter of the silencer body 12 so that a longitudinally extending, eccentric annular space 80 can be defined between the silencer body and the distal portion of the booster housing. The vents 21 (FIG. 4) located about the distal portion 27 of the booster housing 20 can be configured to provide an exit for expanding gases from the discharged firearm 70, so that the gasses pass outwardly through the vents 21 and into the eccentric annular space 80.

With continued reference to FIG. 6 and in one embodiment of the disclosure, if a user installs the silencer 11 onto the muzzle of the pistol barrel 72 and finds the silencer obscures or otherwise interferes with simultaneously viewing a target and sights 90 of the pistol 70, the user can rotationally adjust the silencer to clear the line of view or sight plane 92 that intersects the sights 90. Referring also to FIG. 3, an operation for the rotational adjustment of the silencer 11 can include pulling or moving the silencer body 12 in a direction away from the pistol 70 in a manner that compresses the driving spring 50 and moves the silencer body by a distance sufficient to disengage the spokes 32 on the piston head 38 from their currently engaged, corresponding notches 26 in the central bore 28 of the distal portion 27, enabling the user to rotate or adjust the silencer body as needed or desired, e.g., in one embodiment, in approximately 12° increments (or ±6°) with respect to a longitudinal axis of the piston until the silencer is clear of the pistol sight plane 92, and without misalignment of the projectile passages P1-P2 defined therethrough. Other incremental adjustments also can be provided or used. When the silencer 11 is realigned in a manner so that the silencer is not intersected by the sight plane 92, then the user need only release the silencer body 12 against the bias of the driving spring 50 to allow the silencer body to move backward, whereupon the spokes 32 on the head 38 of the piston 30 generally can reengage a different set of the notches 26 in the distal end 27 of the piston bore or central bore 28 of the silencer mount 10. While approximately thirty positions of orientation or adjustment of the silencer 11 are possible in the illustrated embodiment, more or less adjustments could be utilized based on the number of spokes 32 and indexing notches 26 present. In one example, the user would rotate the silencer 11 in the same direction as would helical threadedly restrain the piston 30 to the barrel 72.

Further, when engaged with the spokes 32, the thirty indexing notches 32 prevent not only gross rotational relative movement but also minor rotational movement as well. By eliminating rotational movement between the piston spokes 32 and the indexing notches 26 the accuracy of the host firearm 70 is not affected while the ability to affect the point of impact of the host firearm 70 is gained by the adjustable orientation.

The eccentric mount 15 also serves as a booster to ensure the proper semi-automatic function of an autoloading handgun 70. When the host firearm 70 is discharged, expanding gases proceed and follow the discharged projectile or bullet out of the barrel 72. As illustrated in FIGS. 1A and 5, an opening 34 of passage P2 of the piston is provided at the distal end of the piston and generally aligns with an opening P1 of the projectile passage through the silencer body 12 to provide an unobstructed path for the bullet to transverse as it exits the barrel 72. As the expanding gases enter the piston 30 and expand into the booster housing 20 the pressure generated forces the silencer body 12 forward thereby compressing the compression spring 50. The piston spokes 32 generally maintain the orientation of the mounting system 10 and projectile passages P1-P2 with respect to the barrel 72 by contacting the interior walls of the booster housing 20. With the silencer body 12 pushed forward of the handgun barrel 72, the barrel 72 can be shifted forwardly from the barrel allowing the handgun 70 to complete its normal cycle of operation.

In addition, the silencer mount or recoil booster 15 can be configured to allow for the silencer to be selectively rotationally adjusted. In one example embodiment, the spokes 32 of the piston 30 and the notches 26 of the booster housing 20 can be disengaged from one another in response to translational relative movement therebetween in a first direction, and reengaged in response to translational relative movement therebetween in a second direction that is generally opposite the first direction, wherein the at least one spring 50 can drive the movement in the second direction. While the spokes 32 and notches 26 are engaged with one another, relative rotation between the piston 30 and the booster housing 20, and thus the silencer body 12, is restricted. In contrast, while the spokes 32 and notches 26 are disengaged, the booster housing 20 and silencer body 12 can rotate together relative to the piston 30. The baffle core 13, 13' can be operatively connected to the booster housing 20 and/or silencer body 12 so that the baffle core rotates with the booster housing and silencer body, so that the eccentric bores 17, 17', 28 of the baffle core and booster housing remain coaxial with one another during rotational adjustment of the silencer 11.

For example and referring back to FIGS. 1A-2B, the baffle core 13, 13' can be operatively connected to the booster housing 20 by way mated mechanical alignment elements, projections or receptacles 94, 96, 98, 100, 102, wherein a pair of the mated elements can generally comprise a tongue and groove or hole, or any other suitable structures. The alignment projections 94, 98, 102 and alignment receptacles 96, 100 further can be operative during assembly of the silencer 11 for ensuring that the baffle core 13, 13' is properly installed in the silencer body so that the eccentric bores of the baffle core and booster housing are coaxial with one another. The baffle cores 13, 13' also may be uninstalled, cleaned, and then reinstalled in the interior chamber 14 of the silencer body 12. For this purpose, a front cap 104 (FIGS. 1A and 1B) having a suitable bore extending therethrough can be releasably secured to the distal end of the silencer body 12 by way of helical threads and/or other suitable connector features.

Referring to FIG. 1B, the alignment projection 94 of the proximal spacer 18 can be generally or substantially crescent-shaped, so that it is arcuate, has a middle between opposite ends, and the middle is wider than the ends. Referring to FIGS. 1A and 2, the corresponding alignment receptacle 96 configured to snugly yet releasably receive the alignment projection 94 can be a generally or substantially crescent-shaped portion of the eccentric annular space 80, so that the alignment receptacle 96 is arcuate, has a middle between opposite ends, and the middle is wider than the ends. Alternatively, the alignment projection and receptacle 94, 96 can be other suitably configured tongue and groove features, or the like. For example and referring to FIG. 1C, the alignment projection 102 can be a generally block-shaped tongue feature configured to snugly yet releasably be received in a correspondingly shaped alignment receptacle or groove defined in the distal end of the booster housing 20, or the like. As another example, as shown in FIGS. 1A and 1B, the alignment projections and receptacles 100, 102 of respective baffles 16 and spacers 18, 19 can be in the form of tab-shaped tongues and correspondingly shaped holes or grooves configured to snugly yet releasably receive the respective tongues.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A booster for a silencer for use with a firearm, comprising:

a piston having a proximal end configured to couple to the firearm, a distal end comprising a plurality of spokes arranged thereabout; and a housing configured to be at least partially received within the silencer and configured to couple to the silencer, the housing comprising an eccentric bore in which the piston is received, and a plurality of holes such that expanding gases produced upon discharge of the firearm can escape the housing in a direction substantially transverse to the path of a projectile passing through the piston and housing;

wherein the piston is translatable relative to the housing during discharge of the firearm coupled to the piston, and wherein the housing is disengageable from the piston and is adjustable with respect to the piston to align the silencer below a sight plane of the firearm.

2. The booster of claim 1, wherein the housing comprises an internal shoulder having a plurality of spaced notches configured to receive and engage the spokes formed about the distal end of the piston, wherein the engagement of the notches and the spokes is configured to prevent the housing from rotating relative to the piston.

3. The booster of claim 2, wherein the internal shoulder prevents rotation of the housing relative to the piston; and when the booster is coupled to a silencer and a firearm, the silencer is prevented from rotating relative to the firearm.

4. The booster of claim 2, wherein the plurality of notches comprises ten or more notches, and the plurality of spokes comprises ten or more spokes.

5. The booster of claim 2, wherein the piston flange has approximately twenty to thirty spokes and the internal shoulder has twenty to thirty notches.

6. The booster of claim 1, the booster further comprising a rear cap configured to couple to the housing, the rear cap comprising at least one recess at a proximal end of the rear cap, the at least one recess configured to facilitate removal of the rear cap.

7. The booster of claim 1, wherein the eccentric bore has first portion in a distal end of the housing having a first diameter, and a second portion in a proximal end of the housing having a second diameter; the first diameter is smaller than the second diameter.

8. The booster of claim 7, wherein the distal end of the housing comprises a stop against which forward movement of the piston is arrested.

9. The booster of claim 1, wherein the housing comprises a base portion and a distal portion extending forwardly of the base portion, and wherein the eccentric bore is offset with respect to the base portion, and is substantially coaxial with respect to the distal portion.

10. The booster of claim 1, wherein the eccentric bore of the housing of the booster is configured to be substantially coaxial with an eccentric bore defined through at least one baffle of a body of the silencer.

11. The booster of claim 10, wherein an aligning projection is at least partially defined by the housing of the booster, and an aligning receptacle is at least partially defined by the at least one baffle of the body of the silencer, the aligning projection configured to be received and extend into the aligning receptacle to restrict relative rotation between the at least one baffle and the housing of the booster.

12. A silencer for a firearm, comprising:

an elongate body including opposite proximal and distal ends with a bore extending along a longitudinal axis of the body between the proximal and distal ends thereof;

at least one baffle positioned along the bore of the body, the baffle having an eccentric bore formed therein and located in an alignment offset from the longitudinal axis of the body;

a booster comprising a housing and a piston, the housing received within the bore of the body and releasably coupled to the body, and comprising an eccentric bore that is substantially coaxial with the eccentric bore of the at least one baffle, wherein the piston is configured to couple to a firearm so that a projectile from the firearm can pass through the piston, the housing, the body and the at least one baffle, the piston extending into the eccentric bore of the housing and being movable relative to the housing between a first position wherein a series of locking elements of the housing and the piston cooperatively engage so as to substantially prevent rotation therebetween, and a second position wherein the mating elements are disengaged to allow relative rotation between the body and the piston; and a series of mating elements defined between the at least one baffle and the silencer body are configured to restrict relative rotation between the at least one baffle and the body to substantially retain coaxial alignment between the eccentric bores during relative rotation between the body and the piston.

13. The silencer of claim 12, wherein:

the housing comprises a plurality of holes such that expanding gases produced from a discharged firearm coupled to the piston can escape the housing in a direction substantially transverse to the path of a discharged projectile, and the eccentric bores are configured to align the silencer below a sight plane of a firearm coupled to the piston.

14. The silencer of claim 12, wherein the locking elements comprise:

a plurality of spokes defined about a distal end of the piston; and a plurality of notches configured to receive the plurality of spokes defined adjacent the proximal end of the housing.

15. The silencer of claim 12, wherein the at least one baffle is part of a baffle core positioned in the body, and the mated elements comprise:

an aligning projection of one of the baffle core and the housing; and an aligning receptacle at least partially defined by the other of the baffle core and the housing, the aligning projection extending into the aligning receptacle.

* * * * *